US006092370A

United States Patent [19]

Tremoulet, Jr. et al.

[11] Patent Number: 6,092,370

[45] Date of Patent: Jul. 25, 2000

[54] APPARATUS AND METHOD FOR DIAGNOSING THE STATUS OF SPECIFIC COMPONENTS IN HIGH-PRESSURE FLUID PUMPS

[75] Inventors: Olivier L. Tremoulet, Jr., Edmonds; Chidambaram Raghavan; Edmund Y. Ting, both of Kent, all of Wash.

[73] Assignee: Flow International Corporation, Kent, Wash.

[21] Appl. No.: 08/931,248

[22] Filed: Sep. 16, 1997

[51] Int. Cl.[7] ..... F16D 31/00; F01B 25/26; F04B 49/00

[52] U.S. Cl. ..... 60/328; 91/1; 417/63

[58] Field of Search ..... 417/571, 32, 63; 60/328, 329, 399; 92/5 R; 91/1

[56] References Cited

U.S. PATENT DOCUMENTS

| | | | |
|---|---|---|---|
| 3,699,810 | 10/1972 | Takahashi | 73/168 |
| 3,708,245 | 1/1973 | King | 417/44.1 X |
| 3,921,435 | 11/1975 | Howard | 73/168 |
| 5,145,322 | 9/1992 | Senior, Jr. et al. | 417/63 |
| 5,186,227 | 2/1993 | Snuttjer et al. . | |
| 5,345,812 | 9/1994 | Haboian | 73/46 |
| 5,353,873 | 10/1994 | Cooke, Jr. | 73/155 X |
| 5,628,229 | 5/1997 | Krone et al. | 73/168 |
| 5,748,077 | 5/1998 | Brandt | 73/199 X |
| 5,772,403 | 6/1998 | Allison et al. | 417/44.2 |
| 5,918,268 | 6/1999 | Lukas et al. | 73/40.5 R |

*Primary Examiner*—John E. Ryznic
*Attorney, Agent, or Firm*—Seed IP Law Group PLLC

[57] ABSTRACT

A method and apparatus for diagnosing components in high-pressure pumps to indicate when a component of the pump head is malfunctioning and to identify the malfunctioning component. In one embodiment, a high-pressure pump head incorporating a diagnostic system in accordance with the invention has a pressurization chamber and a pressurizing member at least partially received in the pressurization chamber. The pressurizing member moves within the pressurization chamber along an intake action to draw fluid into the pressurization chamber and along a pressurizing action to compress fluid in the pressurization chamber. An inlet fluid control assembly is coupled to the pressurization chamber to allow fluid to enter the pressurization chamber during the intake action, and a pressurized fluid control assembly is coupled between the pressurization chamber and an outlet chamber to selectively allow pressurized fluid into the outlet chamber during the pressurizing action. The pump head may also include a diagnostic system to indicate the operational status of each of the inlet fluid control assembly, the pressurized fluid control assembly and other components of the pump head upstream from the inlet fluid control assembly with respect to a fluid flow through the pump head during the pressurizing action.

30 Claims, 6 Drawing Sheets

APPARATUS AND METHOD FOR DIAGNOSING THE STATUS OF SPECIFIC COMPONENTS IN HIGH-PRESSURE FLUID PUMPS

TECHNICAL FIELD

The present invention relates to high-pressure fluid pumps. More specifically, one embodiment of the invention relates to diagnosing the operational status of specific components in high-pressure fluid pumps.

BACKGROUND OF THE INVENTION

High-pressure pumps pressurize water or other fluids to generate high-pressure fluid streams that may be used to cut materials (e.g., sheet metal and fiber-cement siding), drive actuators and other applications where high-pressure fluids are useful. A typical high-pressure pump has a pressurization chamber, a plunger within the pressurization chamber, an inlet check valve coupled to the pressurization chamber, and an outlet check valve coupled to between the pressurization chamber and an outlet chamber. The plunger reciprocates within the pressurization chamber drawing fluid into the pressurization chamber via the inlet check valve on an intake stroke and driving the fluid through the outlet check valve into the outlet chamber on a pressurizing stroke. The outlet check valve selectively allows fluid at a sufficient pressure to enter the outlet chamber. High-pressure pumps generally operate above 10,000 psi, and in many applications in a range of 50,000 psi–100,000 psi or above.

Because high-pressure pumps operate at such high-pressures, the pumps are subject to fluid leaks that may impair the performance of the pumps or cause failure. One conventional technique to monitor whether a pump is leaking is to manually touch the pump head to estimate whether the operating temperature of the pump is above normal operating temperatures. Another conventional technique for monitoring pumps is to measure the temperature of the pressurized fluid downstream from the pump head. However, as set forth below, conventional techniques for monitoring the status of high-pressure pumps are beset with several deficiencies.

One problem with the conventional monitoring techniques is that a pump may fail without any warning. In manual monitoring applications, for example, a rise in the temperature of the pump head sufficient to sense by touch generally occurs only after a component has completely failed causing a rupture or significant loss in pressure. Similarly, it is difficult to determine that a pump head is malfunctioning by measuring the temperature downstream from the pump head because many factors influence the temperature of the pressurized fluid in the pump head. Thus, large leaks may not be detected until they rupture or cause other catastrophic failures under the high-pressure operating conditions.

Another problem with conventional monitoring techniques is that they do not identify the specific component that is malfunctioning. The conventional techniques merely provide a general indication that a component in the pump head has failed. Accordingly, to repair a failed pump, the pump head is disassembled and each of the inlet check valve, the outlet check valve or the plunger seal around the plunger is checked to determine the faulty component. It will be appreciated that checking each of these components increases the labor costs and the down-time associated with repairing pumps. Conventional monitoring techniques, therefore, may not provide adequate information to cost effectively operate and repair high-pressure pump heads.

SUMMARY OF THE INVENTION

The present invention is a method and apparatus for diagnosing components in high-pressure pumps and other components of high-pressure fluid systems. The methods and apparatus preferably identify the specific malfunctioning component prior to complete failure of the component. In one embodiment, a high-pressure pump head incorporating a diagnostic system in accordance with the invention has a pressurization chamber and a pressurizing member at least partially received in the pressurization chamber. The pressurizing member moves within the pressurization chamber along an intake action to draw fluid into the pressurization chamber and along a pressurizing action to compress fluid in the pressurization chamber. An inlet fluid control assembly is coupled to the pressurization chamber to allow fluid to enter the pressurization chamber during the intake action, and a pressurized fluid control assembly is coupled between the pressurization chamber and an outlet chamber to selectively allow pressurized fluid into the outlet chamber during the pressurizing action.

The pump head may also include a diagnostic system to indicate the operational status of each of the inlet fluid control assembly, the pressurized fluid control assembly and other components of the pump head upstream from the inlet fluid control assembly with respect to a fluid flow through the pump head during the pressurizing action. In one embodiment, the diagnostic system has a first temperature sensor coupled to the pump head upstream from the inlet fluid control assembly with respect to the fluid flow direction, and a second temperature sensor coupled to the pump head downstream from the pressurized fluid control assembly. The first and second temperature sensors together isolate the heat transfer at different areas of the pump head to identify whether the inlet fluid control assembly, the pressurized fluid control assembly or the component of the pump head upstream from the inlet fluid control assembly is malfunctioning.

In one embodiment, the inlet fluid control assembly is an inlet check valve, the pressurized fluid control assembly is an outlet check valve, and the component of the pump head upstream from the inlet fluid control assembly is a seal around the pressurizing member. The first temperature sensor may be coupled to the pump head proximate to the seal and the second temperature sensor may be coupled to the pump head at an end-cap housing the outlet chamber. The first and second temperatures measured by the first and second temperature sensors are compared with first and second reference temperatures to determine whether either the inlet check valve, the seal, or the outlet check valve is malfunctioning prior to causing a severe failure of the pump head. For example, the following components are malfunctioning when the first and second temperature sensors indicate the following temperatures:

1. Inlet check valve—both the first and second temperatures are greater than the first and second reference temperatures.
2. Outlet check valve—the first temperature is approximately equal to the first reference temperature and the second temperature is greater than the second reference temperature.
3. Seal—the first temperature is greater than the first reference temperature and the second temperature is approximately equal to the second reference temperature.

In one embodiment of the invention, the first and second temperature sensors are coupled to a processor that compares the first temperature with the first reference temperature and a second temperature with the second reference temperature. The processor may then perform the process set forth above to determine whether the inlet check valve, the outlet check valve or the seal are malfunctioning.

DETAILED DESCRIPTION OF THE INVENTION

The present invention is a method and apparatus for diagnosing components of a high-pressure pump or high-pressure fluid system to indicate when a component is malfunctioning and to identify the malfunctioning component. Suitable high-pressure pumps include, but are not limited to, the Eagle, Cougar and Husky pumps manufactured by Flow International Corporation of Kent, Washington. It will be appreciated that specific details of certain embodiments of the invention are set forth in the following description and in FIGS. 1–5 to provide a thorough understanding of certain embodiments of the present invention. A person skilled in the art, however, will understand that the present invention may have additional embodiments that may be practiced without these details.

Figure 1:
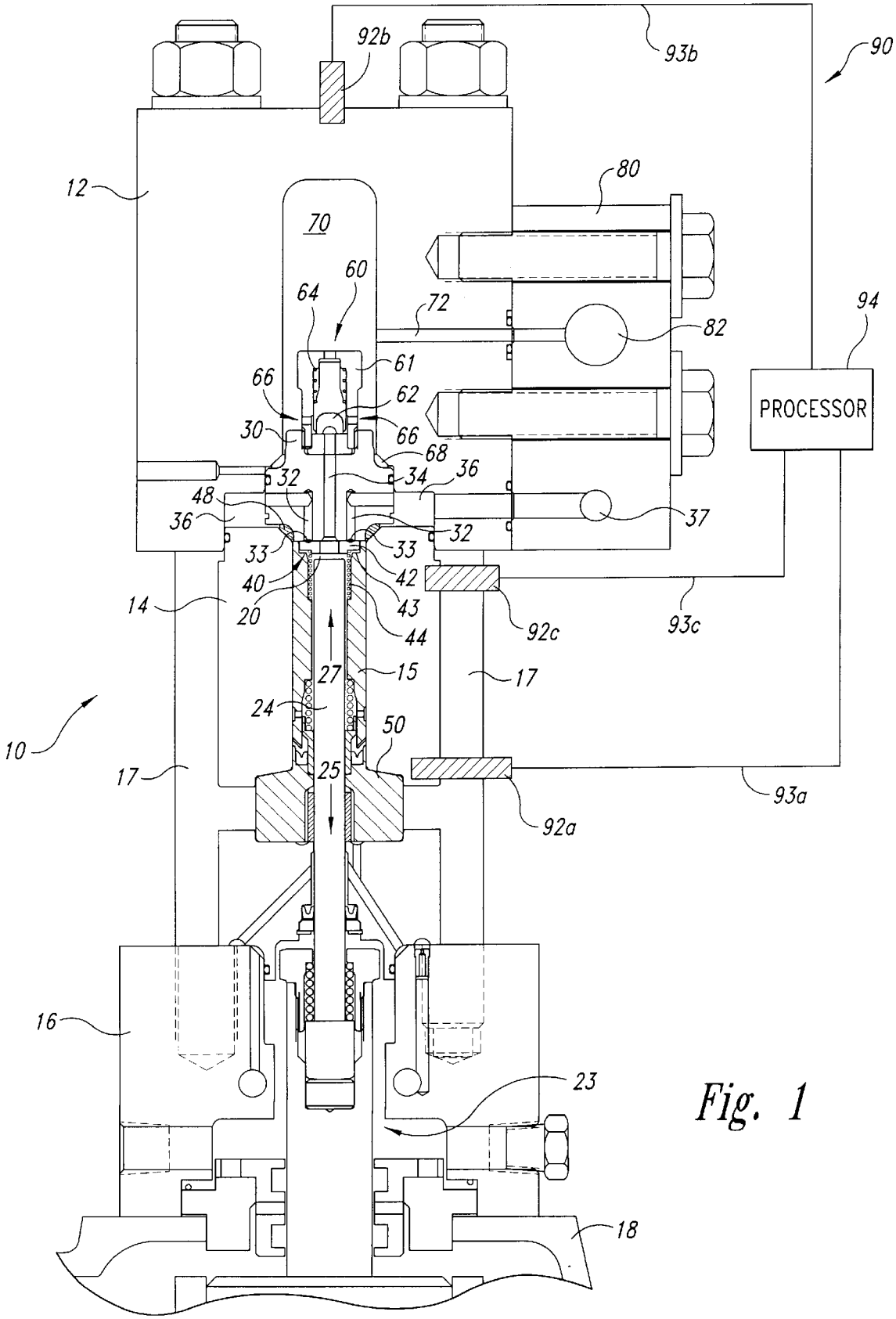
FIG. 1 is a cross-sectional view of a high-pressure pump head with a diagnostic system in accordance with an embodiment the invention.

FIG. 1 illustrates one embodiment of a pump head 10 for a high-pressure pump in accordance with the invention. The pump head 10 has an end-cap 12 coupled to a housing 14 and a base 16. A plurality of through-bolts 17 may extend through the end-cap 12 and thread into the base 16 to hold the end-cap 12, the housing 14 and the base 16 together. The base 16 of the pump head 10 is attached to a motor assembly 18 to provide motive force to the pump head 10.

More specifically, the housing 14 may be a cylinder that carries a bushing 15 to define a pressurization chamber 20, and the end-cap 12 may have a cavity that defines an outlet chamber 70. The pressurization chamber 20 and the outlet chamber 70 are separated by a valve body 30 with inlet passageways 32 and an outlet passageway 34. The inlet passageways 32 each have en inlet port 33 facing towards the pressurization chamber 20, and the inlet passageways 32 are coupled to an inlet line 37 via an inlet chamber 36. A low pressure fluid supply is attached to the inlet line 37 to provide a continuous supply of fluid to the inlet passageways 32. A pressurizing member or plunger 24 has a first end positioned in the pressurization chamber 20 and a second end coupled to the motor assembly 18 via a drive assembly 23 housed in the base 16. The lower end of the pressurization chamber 20 and the plunger 24 are sealed by a primary or plunger seal 50. The motor assembly 18 reciprocates the plunger 24 to draw fluid into the pressurization chamber 20 during an intake stroke and then to pressurize the fluid in the pressurization chamber 20 during a pressurizing stroke. As described below, an inlet fluid control assembly at one end of the valve body 30 allows fluid to enter the pressurization chamber 20, and a pressurized fluid control assembly at another end of the valve body 30 selectively allows pressurized fluid to pass from the pressurization chamber 20 to the outlet chamber 70.

The inlet fluid control assembly may have an inlet check valve 40 and a static seal 48 at one end of the valve body 30. The inlet check valve 40 opens and closes the inlet ports 33, and the static seal 48 seals the inlet chamber 36 from the upper end of the pressurization chamber 20. The inlet check valve 40 shown in FIG. 1 has an inlet poppet 42 that slides along a poppet guide 43 in the bushing 15 and a spring 44 that biases the inlet poppet 42 against the valve body 30. The outlet fluid control assembly may have an outlet check valve 60 at the other end of the valve body 30, and a static seal 68 between the valve body 30 and the end-cap 12 to seal the outlet chamber 70. The outlet check valve 60 has a retainer 61 in which an outlet valve poppet 62 is retained and biased downwardly against the valve body 30 by a spring 64. The retainer 61 also has a plurality of outlet ports 66 through which pressurized fluid flows from the outlet passageway 34 of the valve body 30 into the outlet chamber 70.

To pressurize a volume of fluid in the pump head 10, the motor assembly 18 pulls the plunger 24 along an intake stroke 25 through the bushing 15. The intake stroke 25 of the plunger 24 pulls the inlet poppet 42 down the poppet guide 43 into an open position to allow fluid to flow through the inlet passageways 32 and into the pressurization chamber 20 via the inlet ports 33. At this point in the operation of the pump head 10, the fluid is at a relatively low pressure (e.g., 50–150 psi). The motor 18 then drives the plunger 24 along a pressurizing stroke 27 to compress the fluid in the pressurization chamber 20. During the pressurization stroke 27, the upward flow of fluid in the pressurization chamber 20 and the spring 44 push the poppet 42 against the valve body 30 to close the inlet ports 33. As the plunger 24 continues along the pressurizing stroke 27, the pressurized fluid flows through the outlet passageway 34 to the outlet poppet 62. When the pressure reaches a desired level, the outlet poppet 62 moves upwardly within the retainer 61 to allow the pressurized fluid to flow through the discharge ports 66 and into the outlet chamber 70. From the outlet chamber 70, the pressurized fluid passes through a discharge port 72 to a manifold 80. The pressurized fluid at the manifold 80 is ready to be used by an operator via a tool attached to an outlet port 82 of the manifold 80.

A diagnostic system 90 is coupled to the pump head 10 to indicate when a component of the pump head 10 is malfunctioning and to identify the malfunctioning component. The diagnostic system 90 has one or more temperature sensors 92 (indicated by reference numbers 92*a*–92*c*) coupled to the pump head 10 at selected locations to monitor selected components of the pump head 10. The diagnostic system 90 may also have a processor 94 coupled to the temperature sensors 92 to analyze the data from the temperature sensors 92 and then indicate when one of the selected components is malfunctioning.

In one embodiment of the diagnostic system 90, a single temperature sensor 92 is coupled to the pump head 10 proximate to either the plunger seal 56 (shown by a first temperature sensor 92*a*), the end-cap 12 (shown by a second temperature sensor 92*b*) or the inlet check valve 40 (shown by a third temperature sensor 92*c*). In another embodiment, the diagnostic system 90 has two temperature sensors in which the first temperature 92*a* is attached to the pump head 10 upstream from the inlet check valve 40 and the second temperature sensor 92*b* is attached to the end-cap 12 downstream from the outlet check valve 60. It will be appreciated that the terms"upstream" and "downstream" are relative to the fluid flow through the pump head 10 during the pressurizing stroke 27 of the plunger 24. In a preferred embodiment of a two-sensor diagnostic system 90, the first temperature sensor 92*a* is attached to the housing 14 proximate to the plunger seal 50 and the second temperature sensor 92*b* is attached to the top of the end-cap 12. In still another embodiment of the diagnostic system 90, three temperature sensors are attached to the pump head 10 such that the first temperature sensor 92*a* is attached to the housing 14 proximate to the plunger seal 50, the second temperature sensor 92*b* is attached to the top of the end-cap 12, and the third temperature sensor 92*c* is attached to the housing 14 proximate to the inlet check valve 40. The temperature sensors 92 may be thermistors or other types of temperature probes that accurately measure small changes in temperatures. Suitable thermistors with appropriate circuitry generate electric signals corresponding to the temperature and send the signals along transmissive lines 93 (indicated by reference numbers 93*a*–93*c*) to the processor 94. For example, the QT06007-007 thermistors manufactured by Quality Thermistors of Boise, Id. may be coupled to a computer with a Pentium® processor via an AID data acquisition board manufactured by Keithly Metrabyte of Tauton, Mass.

The diagnostic system 90 indicates that a component is malfunctioning and identifies the malfunctioning component by locating a temperature sensor 92 proximate to the specific component, or by locating a plurality of temperature sensors at selected locations that together indicate the status of several pump head components. When pressurized fluid leaks from one of the components monitored by a temperature sensor, the temperature of the leaking fluid increases causing an increase in temperature at a corresponding location of the pump head or the fluid in the pump head. The diagnostic system 90 accordingly locates a temperature sensor 92 where it is influenced by the heat flux caused by the leak such that the temperature sensor alone, or in combination with other temperature sensors, isolates the source of the heat flux. Thus, the diagnostic system 90 is not limited to the embodiment shown in FIG. 1, but rather covers applications in which one or more temperature sensors are positioned where they can accurately identify malfunctioning components in high-pressure fluid applications.

Figure 2:
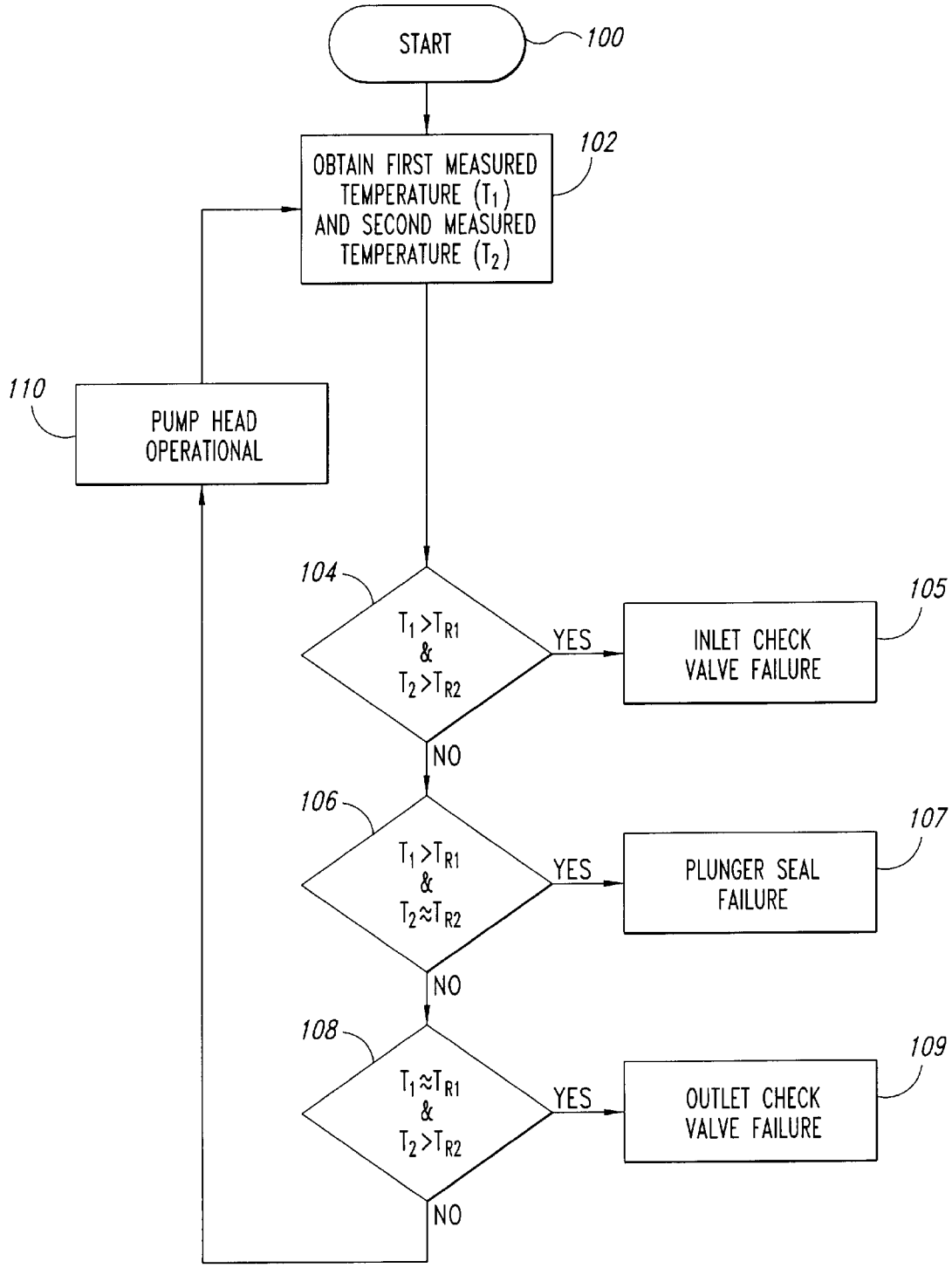
FIG. 2 is a flowchart of a process for diagnosing the status of an inlet check valve, an outlet check valve, and a seal with a two-sensor diagnostic system in accordance with an embodiment of the invention.

FIG. 2 illustrates one embodiment of the software process programmed into the processor 94, or the manual process used by an operator, to diagnose the status of the inlet check valve 40, the plunger seal 50 and/or the outlet check valve 60 with a two-sensor diagnostic system. The process shown in FIG. 2 is preferably applied to a diagnostic system 90 in which the first temperature sensor 92*a* is attached to the housing 14 proximate to the plunger seal 50 and the second sensor 92*b* is attached to the end-cap 12 (shown in FIG. 1).

The process starts at step 100 in which the operator or the processor 94 notes first and second reference temperatures ($T_{R1}$ and $T_{R2}$) corresponding to the normal operating temperatures of pump head 10 at the first and second temperature sensors 92*a* and 92*b*. The process continues with step 102 in which a first measured temperature ($T_1$) is obtained from the first temperature sensor 92*a* and a second measured temperature ($T_2$) is obtained from the second temperature sensor 92*b*. In steps 104, 106 and 108, processor 94 then compares the first and second measured temperatures $T_1$, and $T_2$ with the first and second reference temperatures $T_{R1}$ and $T_{R2}$ to determine whether either the inlet check valve 40, the plunger seal 50 or the outlet check valve 60 are malfunctioning.

In step 104, for example, the processor 94 analyzes whether the first measured temperature $T_1$ is greater than the first reference temperature $T_{R1}$, and whether the second measured temperature $T_2$ is greater than the second reference temperature $T_{R2}$. If both the first and second measured temperatures $T_1$ and $T_2$ are above the first and second reference temperatures $T_{R1}$ and $T_{R2}$, the processor proceeds to step 105 in which it indicates that the inlet check valve is malfunctioning. However, if the parameters of step 104 are not met, then the processor 94 proceeds to step 106 in which it analyzes whether the first measured temperature $T_1$ is greater than the first reference temperature $T_{R1}$ and the second measured temperature $T_2$ is approximately equal to the second reference temperature $T_{R2}$. If the criteria of step 106 is met, the processor proceeds to step 107 in which it indicates that the plunger seal 50 is malfunctioning. Yet, if the parameters of step 106 are not met, the processor 94 proceeds to step 108 in which it analyzes whether the first measured temperature $T_1$ is approximately equal to the first reference temperature $T_{R1}$ and the second measured temperature $T_2$ is greater than the second reference temperature $T_{R2}$. If the inquiries of step 108 are met, the processor precedes to step 109 in which it indicates that the outlet check valve 60 is malfunctioning. If the inquiries of step 108 are not met, the processor 94 proceeds to step 110 in which it indicates that the pump head 10 is operational.

After reaching step 110, the processor 94 continues to repeat steps 102, 104, 106, 108 and 110 until the first and second measured temperatures $T_1$ and $T_2$ cause the processor to proceed to either step 105, 107 or 109. Thus, the diagnostic system 90 continuously diagnoses the pump head 10 to indicate and identify when one of the inlet check valve, outlet check valve, and plunger seal is malfunctioning.

The embodiments of the diagnostic system 90 described above in FIGS. 1 and 2 reduce the costs and down-time to repair worn or failed pump heads. Unlike conventional monitoring techniques, the diagnostic system 90 identifies the specific component in the pump head 10 that is malfunctioning. An increase in temperature at the temperature sensor, or sensors, corresponding to the malfunctioning component not only indicates that the pump head 10 is about to fail, but it also identifies the malfunctioning component so that a technician can quickly isolate the problem and repair the pump head. Thus, compared to conventional monitoring techniques, the embodiments of the diagnostic system 90 shown in FIGS. 1 and 2 reduce the costs and down-time to repair pump heads.

The embodiments of the diagnostic system 90 described above can also specifically indicate whether the inlet check valve 40, the outlet check valve 60 or the plunger seal 50 is malfunctioning with only two sensors. The first temperature sensor 92*a* monitors a first section of the pump head 10 at a location where the heat transfer is affected by leaks at either the plunger seal 50 or the inlet check valve 40. The second temperature sensor 92*b* monitors a second section of the pump head 10 at a location where the heat transfer is affected by leaks at either the inlet check valve 40 or the outlet check valve 60. Since a leak at the inlet check valve 40 affects both the first and second temperature sensors 92*a* and 92*b*, but leaks at the plunger seal 50 and the outlet check valve 60 affect only one of the first and second temperature sensors 92*a* and 92*b*, respectively, the operational status of either the inlet check valve 40, the outlet check valve 60 or the plunger seal 50 may be individually determined with only two temperature sensors. As a result, a preferred embodiment of the diagnostic system 90 requires only two temperature sensors to be installed and maintained for monitoring three of the components that are most likely to malfunction.

The embodiments of the diagnostic system 90 shown in FIGS. 1 and 2 may also indicate that a component of the pump head 10 is malfunctioning prior to causing a complete or catastrophic failure of the pump head 10. Because the diagnostic system 90 locates temperature sensors proximate to the components of the pump head 10 that are most likely to malfunction, the diagnostic system 90 can accurately indicate that the pump head 10 is about to fail with only a relative small rise in temperature at the corresponding temperature sensors. Accordingly, compared to conventional monitoring systems that only shut down a pump head after a relatively large rise in temperature, the diagnostic system 90 may stop the pump head 10 before a leak has the opportunity to cause a catastrophic failure of the pump head 10.

Figure 3:
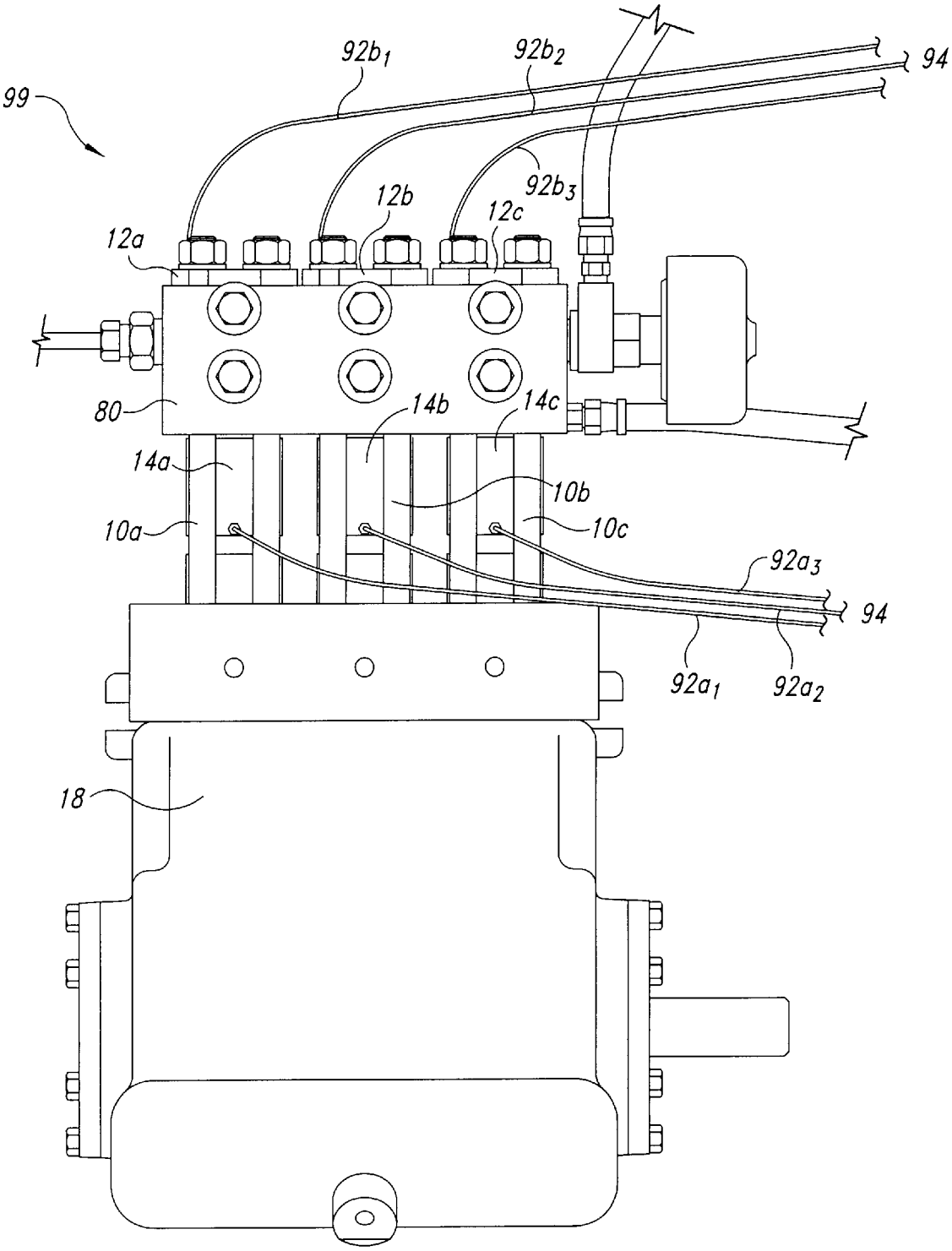
FIG. 3 is a front view of a multi-head high-pressure pump with a diagnostic system in accordance with an embodiment the invention.

FIG. 3 illustrates a multi-head pump 99 with three pump heads 10*a*, 10*b* and 10*c* attached to a single motor assembly 18. A first temperature sensor 92*a* (indicated by reference numbers $92a_1$, $92a_2$, and $92a_3$) is attached to each pump head upstream from a corresponding inlet check valve (not shown), and a second temperature 92*b* (indicated by reference numbers $92b_1$, $92b_2$ and $92b_3$) is attached to each pump head downstream from a corresponding outlet check valve (not shown). For example, first temperature sensors $92a_1$, $92a_2$ and $92a_3$ may be attached to the housings 14*a*, 14*b* and 14*c* proximate to the corresponding plunger seals (not shown). Similarly, second temperature sensors $92b_1$, $92b_2$ and $92b_3$ may be attached to the top of the end-caps 12*a*, 12*b* and 12*c*. A processor is coupled to each of the first and second temperature sensors 92*a* and 92*b* to receive and process the first and second measured temperatures from all of the first and second temperature sensors 92*a* and 92*b*. As described below, the processor 94 continuously monitors the inlet check valve, the plunger seal, and the outlet check valve of each pump head 10*a*–10*c*.

Figure 4:
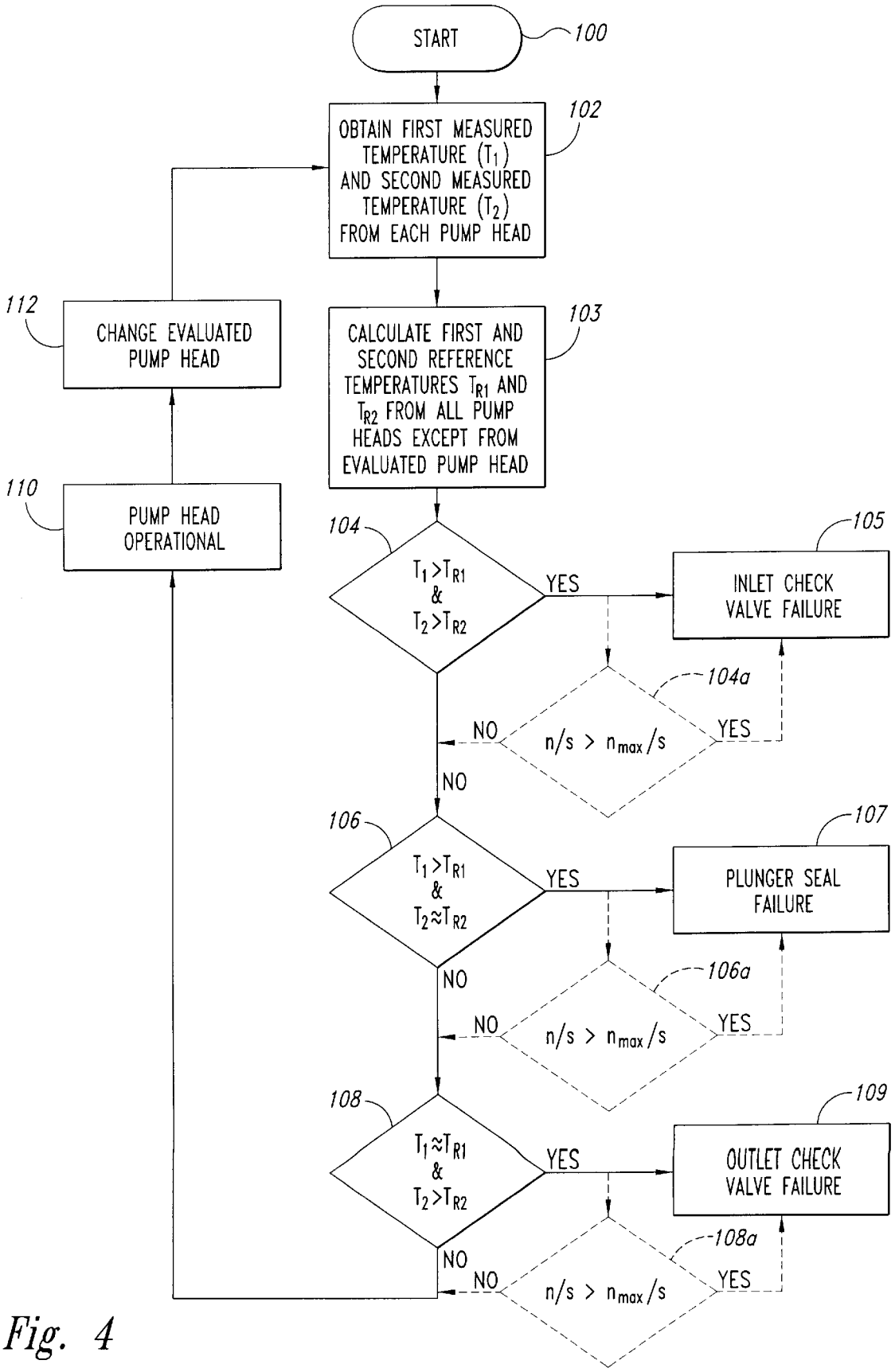
FIG. 4 is a flowchart of a process for diagnosing the status of the inlet check valves, the outlet check valves, and the seals of a multi-head high-pressure pump with a diagnostic system in accordance with another embodiment of the invention.

FIG. 4 is a flowchart that illustrates the software process used by the processor 94 to monitor the multi-head pump 99 of FIG. 3. The process of FIG. 4 is substantially the same as that described above with respect to FIG. 2, except that the processor 94 performs steps 102, 104, 106, 108 and 110 for one of the pump heads 10*a*, 10*b* or 10*c* (an"evaluated pump head"), and then proceeds to step 112 in which the processor selects one of the other two pump heads to evaluate beginning with step 102. Another difference is that the processor performs step 103 in which the first and second reference temperatures $T_{R1}$ and $T_{R2}$ are determined by averaging the first and second temperatures from the two pump heads that are not the evaluated pump head for the particular iteration of steps 102–110. For example, when the first pump head 10*a* is the evaluated pump head, the processor 94 obtains first and second measured temperatures $T_1$ and $T_2$ from each pump head in step 102, and then: (1) calculates the first reference temperature $T_{R1}$ by averaging first measured temperatures $T_1$ from the second and third pump heads 10*b* and 10*c*; and (2) calculates the second reference temperature $T_{R2}$ by averaging the second measured temperatures $T_2$ from the second and third pump heads 10*b* and 10*c*. After the first and second reference temperatures $T_{R1}$ and $T_{R2}$ have been calculated in step 103, the processor proceeds through steps 104–110 to evaluate the components of the first pump head 10*a*. If the processor 94 proceeds to step 110 for the first pump head 10*a*, the processor then performs step 112 in which it changes the evaluated pump head to the second pump head 10*b*.

To diagnose the components of the second and third pump heads 10*b* and 10*c*, the processor 94 repeats steps 102, 104, 106, 108, 110 and 112 for each pump head until one of the components is in a failure mode. For example, to diagnose the second pump head 10*b*, the processor 94 proceeds to step 102 to again obtain first and second measured temperatures for each pump head. The processor 94 proceeds to step 103 in which it calculates the first and second reference temperatures $T_{R1}$ and $T_{R2}$ for the second pump head 10*b* by averaging the first and second measured temperatures $T_1$ and $T_2$ of the first and third pump heads 10*a*and 10*c*. If the second pump head 10*b* is operational, the processor 94 then performs all of even steps 104–110 and changes the evaluated pump in step 112 to the third pump head 10*c*. The processor 94 similarly diagnoses the third pump head 10*c* by calculating the first and second reference temperatures $T_{R1}$ and $T_{R2}$ from the first and second pump heads 10*a*and 10*b*.

FIG. 4 also illustrates another embodiment of the software process used by the processor 94 to monitor the multi-head pump 99 of FIG. 3. In this embodiment, the processor 94 only proceeds to steps 105, 107 or 109 after the measured temperature of the particular pump component has been above its corresponding reference temperature for a particular period of time or a particular number of cycles. The processor 94 accordingly counts the number of occurrences"n" that the particular measured temperature is greater than the corresponding reference temperature for a sample size S of cycles. In step 104*a*, for example, the processor compares n/S to a value for $n_{MAX}/S$ at which it is likely that the increase in temperature of the particular component indicates that the component is malfunctioning as opposed to an incorrect temperature reading or some other error. If n/S is greater than $n_{MAX}/S$, the processor proceeds to step 105 to indicate that the inlet check valve is malfunctioning. Steps 106*a* and 108*a* are similar to step 104*a*, except that the processor proceeds to either step 107 or step 109 to indicate that the plunger seal or outlet check valve is malfunctioning. Accordingly, in a preferred embodiment of a diagnostic system for a high-pressure pump or fluid system, the processor only proceeds to indicate that a component is malfunctioning after the temperature of the particular component has been above its corresponding reference temperature for a period of time sufficient to reduce error readings.

The processes illustrated in FIGS. 2 and 4 may be implemented without undue experimentation by a person skilled in computer programming using an appropriate computer and commercially available software. For example, software was developed to implement these processes using Visual Test Extension software by Keithly Metrabyte and Microsoft® Visual Basic manufactured by Microsoft Corporation of Redmond, Wash.

Figure 5:
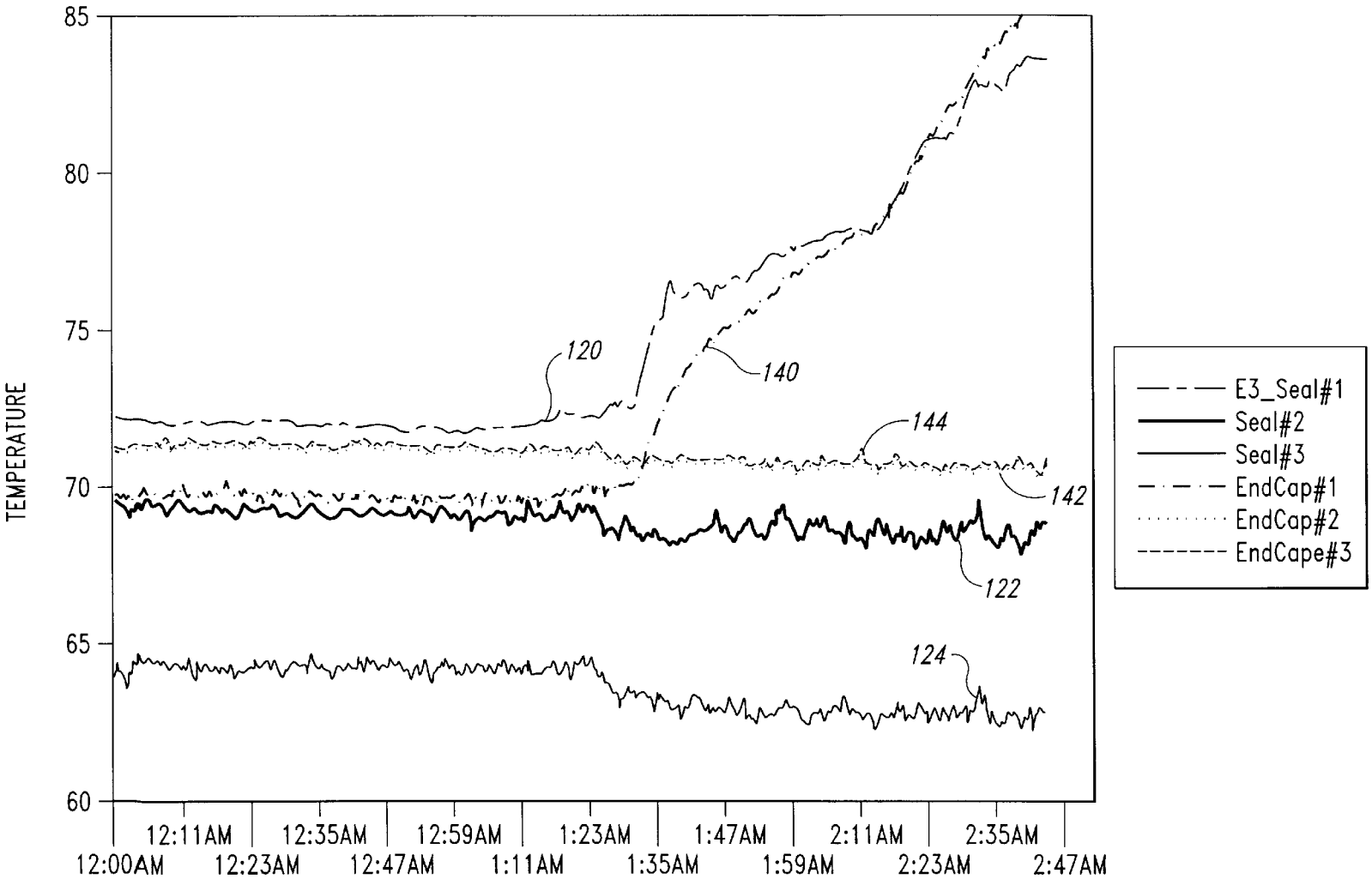
FIG. 5 is a graph illustrating temperature outputs of a two-sensor diagnostic system used on a multi-head high-pressure pump in accordance with an embodiment of the invention indicating a failure of an inlet check valve.

FIG. 5 is a graph displaying an embodiment of the output of a diagnostic system 90 with two sensors at each pump head of a three pump head high-pressure pump. The lines indicated by reference numbers 120, 122 and 124 represent the first measured temperatures $T_1$ of the first temperature sensors 92*a* positioned proximate to the plunger seals of pump heads 10*a*–10*c*, respectively. The lines indicated by reference numbers 140, 142 and 144 correspond to the second measured temperatures of the end-caps 12 of pump heads 10*a*–10*c*, respectively. As shown in FIG. 5 at approximately 1:30 am, the first and second measured temperatures 120 and 140 of the first pump head 10*a* increase rapidly indicating that the inlet check valve of the first pump head 10*a* is malfunctioning. Accordingly, the processor 94 may have a display to visually indicate when a specific component of a specific pump head is malfunctioning.

Figure 6:
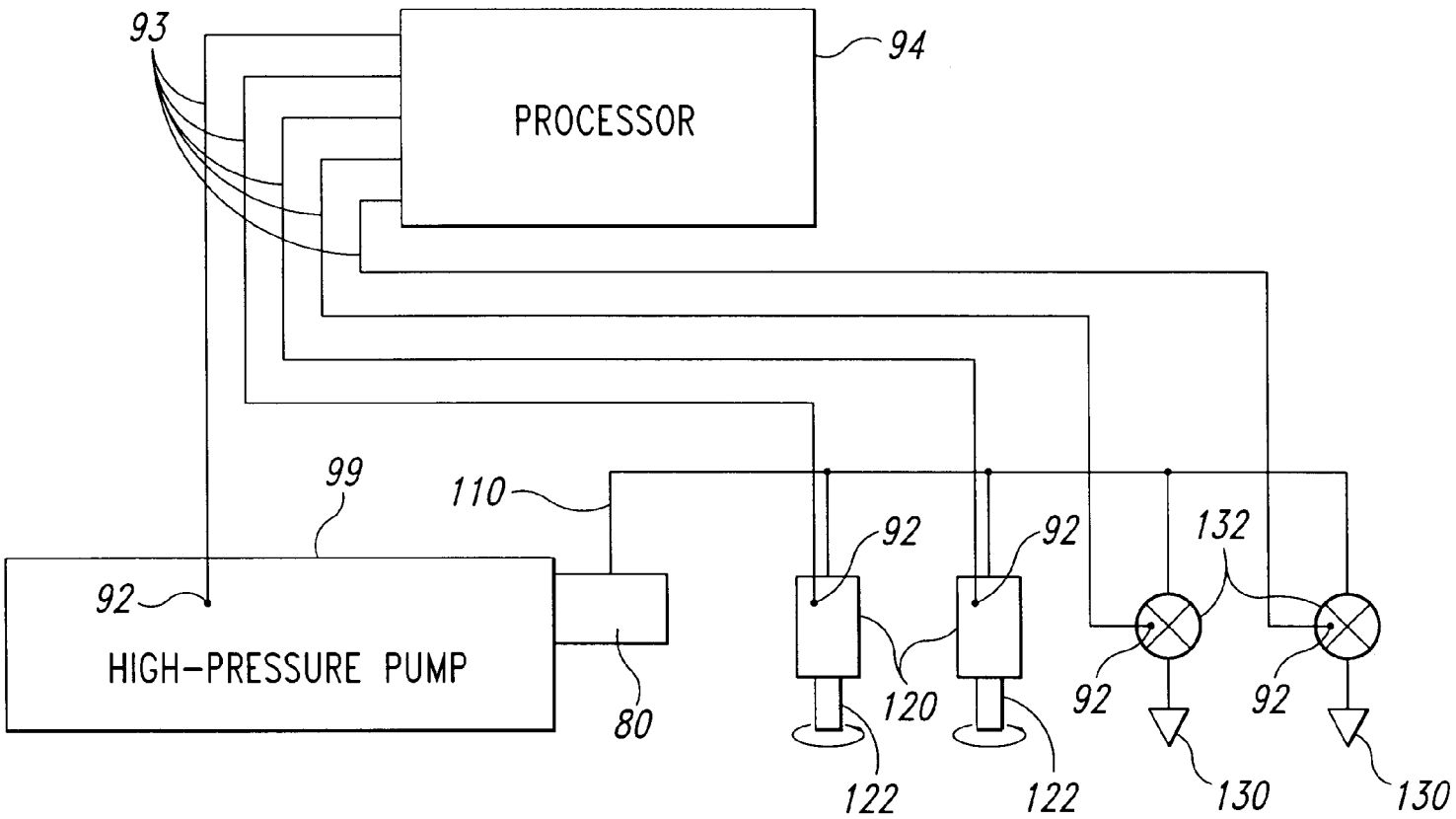
FIG. 6 is a schematic diagram of a high-pressure fluid system with a diagnostic system in accordance with an embodiment of the invention.

FIG. 6 is a schematic diagram showing an embodiment of a high-pressure system 100 with a multi-head high-pressure pump 99 coupled to a plurality of tools 120 and nozzles 130 via a high pressure line 110. Suitable swivels and valves for high-pressure fluid systems are the 008344-1 swivels and 001322-1 on/off valves, both manufactured by Flow International Corporation. The pump 99 may be the similar to the pump 99 described above with respect to FIG. 3, and thus the temperature sensor 92 represents a plurality of temperature probes attached to various component of each pump head. The tools 120 may be rotational tools with a rotating element 122, such as a high-speed or power swivel, and a temperature sensor or probe 92 may be coupled to each tool 120. The nozzles 130 are preferably controlled by valves 132, and a temperature sensor 92 may be coupled to each valve 132. The temperature sensors 92 are coupled to the processor 94 via lines 93. In operation, each temperature sensor or probe 92 senses a measured temperature of a discrete component of the high-pressure system 100. The processor 94 then evaluates the measured temperatures by comparing the measured temperatures with corresponding reference temperatures. For example, the reference temperature for each pump-head component may be determined as explained above with respect to FIG. 4. Similarly, the reference temperature for the tools 120 may be determined by averaging or comparing the temperatures of the tools 120, and the reference temperature for the valves 132 may be determined by averaging or comparing the temperatures of the valves 132. The processor 94 accordingly indicates when a component is malfunctioning and identifies the specific malfunctioning component, as described above.

From the foregoing it will be appreciated that, although specific embodiments of the invention have been described herein for purposes of illustration, various modifications may be made without deviating from the spirit and scope of the invention. For example, the diagnostic system may have different numbers of temperature sensors and it may be implemented on different high-pressure fluid equipment. In general, a diagnostic system or high-pressure device in the scope of the invention has a temperature sensor proximate to a component that seals or controls the fluid flow from one part of a high-pressure device to another. Accordingly, the invention is not limited except as by the appended claims.

What is claimed is:

1. A high-pressure fluid system, comprising:

a high-pressure pump;

a component coupled to the pump to receive pressurized fluid from the pump;

a temperature sensor attached to at least one of the pump and the component at a location at which a heat flux produced by a leak in the one of the pump and the component can be sensed, wherein the component is a fitting coupling the pump to a tool and the temperature sensor is coupled to the fitting;

a processor operatively coupled to the temperature sensor, the processor comparing a sensed temperature from the temperature sensor to a reference temperature, and the processor indicating that the one of the pump and the component is malfunctioning when the sensed temperature is above the reference temperature for a predetermined period.

2. A high-pressure pump head, comprising:

a pressurization chamber;

a pressurizing member at least partially received in the pressurization chamber, the pressurizing member being moveable within the pressurization chamber to draw fluid into the pressurization chamber with an intake action and to compress a fluid in the pressurization chamber with a pressurizing action;

an inlet fluid control assembly coupled to the pressurization chamber to allow fluid to enter the pressurization chamber through an inlet port during the intake action and to prevent back flow through the inlet port during the pressurizing action;

a pressurized fluid control assembly coupled to the pressurization chamber to selectively allow pressurized fluid to pass from the pressurization chamber to an outlet chamber during at least a portion of the pressurizing action and to prevent back flow from the outlet chamber to the pressurization chamber; and a diagnostic system having a first temperature sensor coupled to the pump head and a second temperature sensor coupled to the pump head, the first temperature sensor being positioned on the pump head to sense a beat flux produced by a specific component and identify that the specific component is malfunctioning, wherein the first temperature sensor is coupled to the pump head upstream from the inlet fluid control assembly with respect to a fluid flow direction through the pump, and the second temperature sensor is coupled to the pump head downstream from the pressurized fluid control assembly with respect to the fluid flow direction, the first and second temperature sensors together indicating an individual operational status of each of the inlet fluid control assembly, the pressurized fluid control assembly and a component of the pump head upstream from the inlet fluid control assembly.

3. The pump head of claim 2 wherein the inlet fluid control assembly comprises an inlet check valve, and wherein the inlet check valve is identified as malfunctioning when the first and second temperature sensors register first and second temperatures above first and second reference temperatures.

4. The pump head of claim 3 wherein the inlet fluid control assembly comprises an inlet check valve and a static seal, and wherein one of the inlet check valve and the static seal is identified as malfunctioning when the first and second temperature sensors register first and second temperatures above first and second reference temperatures.

5. The pump head of claim 2 wherein the outlet fluid control assembly comprises an outlet check valve, and wherein the outlet check valve is identified as malfunctioning when the first temperature sensor registers a first temperature approximate to a first reference temperature and the second temperature sensor registers a second temperature greater than a second reference temperature.

6. The pump head of claim 2 wherein the component upstream from the inlet fluid control assembly comprises a seal around the pressurizing member, and wherein the seal is identified as malfunctioning when the first temperature sensor registers a first temperature greater than a first reference temperature and the second temperature sensor registers a second temperature approximate to a second reference temperature.

7. The pump head of claim 2, further comprising a processor coupled to the first and second temperature sensors, wherein the processor compares a first measured temperature from the first temperature sensor with a first reference temperature and a second measured temperature from the second temperature sensor with a second reference temperature to determine the individual operational status of each of the inlet fluid control assembly, the pressurized fluid control assembly and the component upstream from the inlet fluid control assembly.

8. The pump head of claim 7 wherein the inlet fluid control assembly comprises an inlet check valve, and wherein the inlet check valve is identified as malfunctioning when the first and second temperature sensors register first and second temperatures above first and second reference temperatures.

9. The pump head of claim 7 wherein the outlet fluid control assembly comprises an outlet check valve, and wherein the outlet check valve is identified as malfunctioning when the first temperature sensor registers a first temperature approximate to a first reference temperature and the second temperature sensor registers a second temperature greater than a second reference temperature.

10. The pump head of claim 7 wherein the component upstream from the inlet fluid control assembly comprises a seal around the pressurizing member, and wherein the seal is identified as malfunctioning when the first temperature sensor registers a first temperature greater than a first reference temperature and the second temperature sensor registers a second temperature approximate to a second reference temperature.

11. The pump head of claim 2, further comprising:

a seal upstream from the inlet fluid control assembly, the seal being positioned around the pressurizing member; and a third temperature sensor attached to the pump head proximate to the inlet fluid control assembly.

12. A high-pressure pump head, comprising:

a pressurization chamber;

a plunger having a first end received in the pressurization chamber and a second end adapted to be operatively attached to a motor, the first end of the plunger being moveable within the pressurization chamber along an intake stroke to draw fluid into the pressurization chamber and along a pressurizing stroke to compress fluid in the pressurization chamber;

an inlet check valve coupled to the pressurization chamber to allow fluid to enter the pressurization chamber during the intake stroke and to prevent back flow through an inlet port during the pressurizing stroke;

an outlet check valve coupled to the pressurization chamber to selectively allow pressurized fluid to pass from the pressurization chamber into an outlet chamber during the pressurizing stroke and to prevent back flow from the outlet chamber into the pressurization chamber;

a seal around the plunger toward the second end of the plunger;

a first temperature sensor coupled to the pressurization chamber proximate to the seal; and a second temperature sensor coupled to an end cap housing the outlet chamber, wherein the first and second temperature sensors indicate the operational status of the inlet check valve, the outlet check valve and the seal.

13. The pump head of claim 12, further comprising a processor coupled to the first and second temperature sensors, wherein the processor compares a first measured temperature from the first temperature sensor with a first reference temperature and a second measured temperature from the second temperature sensor with a second reference temperature to determine the individual operational status of each of the inlet check valve, the outlet check valve and the seal.

14. The pump head of claim 13 wherein the processor identifies that the inlet check valve is malfunctioning when the first and second temperature sensors register first and second temperatures above the first and second reference temperatures.

15. The pump head of claim 13 wherein the processor identifies that the outlet check valve is malfunctioning when the first temperature sensor registers a first temperature approximate to the first reference temperature and the second temperature sensor registers a second temperature greater than the second reference temperature.

16. The pump head of claim 13 wherein the processor identifies that the seal is malfunctioning when the first reference temperature sensor registers a first temperature greater than the first reference temperature and the second temperature sensor registers a second temperature approximate to the second reference temperature.

17. A high-pressure pump head, comprising:

a pressurization chamber;

a plunger at least partially received in the pressurization chamber, the plunger being moveable within the pressurization chamber along an intake stroke to draw fluid into the pressurization chamber and along a pressurizing stroke to compress fluid in the pressurization chamber;

an inlet fluid control assembly coupled to the pressurization chamber to allow fluid to enter the pressurization chamber through an inlet port during the intake stroke and to prevent back flow through the inlet port during the pressurizing stroke;

a pressurized fluid control assembly coupled to the pressurization chamber to selectively allow pressurized fluid to pass from the pressurization chamber to an outlet chamber during at least a portion of the pressurizing stroke and to prevent back flow from the outlet chamber to the pressurization chamber;

a seal around the plunger to seal the pressurization chamber; and a diagnostic system having a first temperature sensor coupled to the pressurization chamber upstream from the inlet fluid control assembly with respect to a fluid flow direction through the pump, a second temperature sensor coupled to the pump head downstream from the pressurized fluid control assembly with respect to the fluid flow direction, and a processor operatively coupled to the first and second temperature sensors to receive first and second temperature signals, respectively, wherein the processor specifically identifies whether the inlet fluid control assembly, the outlet fluid control assembly, or the seal is malfunctioning by comparing the first and second temperature signals with first and second reference signals, respectively.

18. A diagnostic system for monitoring an inlet valve assembly of a high-pressure pump, an outlet valve assembly of the high-pressure pump and a seal around a plunger of the high pressure pump, comprising:

a first temperature sensor coupled to the pump at a location affected by a heat flux at the seal and a temperature of fluid in the pressurization chamber;

a second temperature sensor coupled to the pump at a location downstream from the outlet check valve assembly with respect to a flow of fluid through the pump; and a processor operatively coupled to the first and second temperature sensors to receive first and second temperature input signals, wherein the processor specifically identifies whether the inlet check valve, the outlet check valve or the seal is malfunctioning by comparing the first and second input signals with first and second reference levels, respectively.

19. The pump head of claim 18 wherein the processor identifies the inlet check valve as malfunctioning when the first and second input signals are greater than the first and second reference levels.

20. The pump head of claim 18 wherein the processor identifies the outlet check valve as malfunctioning when the first input signal is approximate to the first reference level and the second input signal is greater than the second reference level.

21. The pump head of claim 18 wherein the processor identifies the seal as malfunctioning when the first input signal is greater than the first reference level and the second input signal is approximate to the second reference level.

22. A multiple head high-pressure pump, comprising:

a first pump head having a first pressurization chamber, a first plunger received in the first pressurization chamber, a first inlet check valve coupled to the first pressurization chamber, a first outlet check valve coupled between the first pressurization chamber and a first outlet chamber, and a first seal around the first plunger;

a second pump head having a second pressurization chamber, a second plunger received in the second pressurization chamber, a second inlet check valve coupled to the second pressurization chamber, a second outlet check valve coupled between the second pressurization chamber and a second outlet chamber, and a second seal around the second plunger;

a third pump head having a third pressurization chamber, a third plunger received in the third pressurization chamber, a third inlet check valve coupled to the third pressurization chamber, a third outlet check valve coupled between the third pressurization chamber and a third outlet chamber, and a third seal around the third plunger; and a diagnostic system having a first temperature sensor coupled to the first pump head upstream from the first inlet check valve, a second temperature sensor coupled to first pump head downstream from the first outlet check valve, a third temperature sensor coupled to the second pump head upstream from the second inlet check valve, a fourth temperature sensor coupled to the second pump head downstream from the second outlet check valve, a fifth temperature sensor coupled to the third pump head upstream from the third inlet check valve, a sixth temperature sensor coupled to the third pump head downstream from the third outlet check valve, and a processor coupled to each temperature sensor, the processor comparing input signals from the temperature sensors to specifically identify whether one of the first inlet check valve, the first outlet check valve, the first seal, the second inlet check valve, the second outlet check valve, the second seal, the third inlet check valve, the third outlet check valve, or the third seal is malfunctioning.

23. A high-pressure fluid system, comprising a high-pressure pump;

a component coupled to the pump to receive pressurized fluid from the pump;

a temperature sensor attached to at least one of the pump and the component at a location at which a heat flux produced by a leak in the one of the pump and the component can be sensed, wherein the component is a dynamic tool operated by the high-pressure fluid and the temperature sensor is coupled to the tool; and a processor operatively coupled to the temperature sensor, the processor comparing a sensed temperature from the temperature sensor to a reference temperature, and the processor indicating that the one of the pump and the component is malfunctioning when the sensed temperature is above the reference temperature for a predetermined period.

24. A high-pressure fluid system, comprising:

a high-pressure pump;

a component coupled to the pump to receive pressurized fluid from the pump;

a temperature sensor attached to at least one of the pump and the component at a location at which a heat flux produced by a leak in the one of the pump and the component can be sensed; and a processor operatively coupled to the temperature sensor, the processor comparing a sensed temperature from the temperature sensor to a reference temperature, and the processor indicating that the one of the pump and the component is malfunctioning when the sensed temperature is above the reference temperature for a predetermined period, wherein the pump has an inlet check valve, an outlet check valve and a plunger seal, and wherein the temperature sensor comprises a first temperature probe coupled to the pump proximate to the plunger seal and a second temperature probe coupled to an outlet chamber of the pump proximate to the outlet check valve.

25. The high-pressure system of claim 24 wherein the component is a dynamic tool operated by the high-pressure fluid and the temperature sensor further comprises a third temperature probe coupled to the tool.

26. A high-pressure fluid system, comprising:

a high-pressure pump;

a component coupled to the pump to receive pressurized fluid from the pump;

a temperature sensor attached to at least one of the pump and the component at a location at which a heat flux produced by a leak in the one of the pump and the component can be sensed; and a processor operatively coupled to the temperature sensor, the processor comparing a sensed temperature from the temperature sensor to a reference temperature, and the processor indicating that the one of the pump and the component is malfunctioning when the sensed temperature is above the reference temperature for a predetermined period;

wherein the component comprises a swivel coupled to the pump via a high-pressure fluid line and nozzle coupled to the pump via a valve and the high-pressure fluid line;

wherein the pump comprises a pressurization chamber, a plunger received in the pressurization chamber, a plunger seal between the plunger and the pressurization chamber, an outlet chamber for pressurized fluid, and a pump valve assembly having an inlet check valve and an outlet check valve between the pressurization chamber and the outlet chamber; and wherein the temperature sensor comprises a plurality of individual temperature probes coupled to the processor, wherein an individual probe is coupled to each of the swivel, the nozzle valve, the pressurization chamber proximate to the plunger seal and the outlet chamber.

27. A method of predicting failure of a component in a high-pressure pump having a pressurization chamber, an inlet check valve coupled to the pressurization chamber, and an outlet check valve coupled to the pressurization chamber, the method comprising:

measuring a first temperature of a first pump component upstream from the inlet check valve with respect to a flow of fluid through the pump;

measuring a second temperature of a second pump component downstream from the outlet check valve with respect to the fluid flow through the pump;

comparing the first and second measured temperatures with first and second reference temperatures, respectively; and diagnosing that one of the inlet check valve, the outlet check valve or a component upstream of the inlet check valve with respect to the fluid flow through the pump is malfunctioning.

28. The method of claim 27 wherein the act of diagnosing comprises identifying the inlet check valve as malfunctioning when the first and second temperatures are greater than the first and second reference temperatures, respectively.

29. The method of claim 27 wherein the act of diagnosing comprises identifying the outlet check valve as malfunctioning when the first temperature is approximate to the first reference temperature and the second temperature is greater than the second reference temperature.

30. The method of claim 27 wherein the act of diagnosing comprises identifying the seal as malfunctioning when the first temperature is greater than the first reference temperature and the second temperature is approximate to the second reference temperature.

* * * * *

UNITED STATES PATENT AND TRADEMARK OFFICE

CERTIFICATE OF CORRECTION

PATENT NO : 6,092,370
DATED : July 25, 2000
INVENTOR(S) : Tremoulet, Jr. et al.

It is certified that errors appear in the above-identified patent and that said Letters Patent are hereby corrected as shown below:

Claim 2, column 10, lines 27-28 should read --to sense a heat flux--.

Signed and Sealed this

Tenth Day of April, 2001

*Attest:*

Nicholas P. Godici

NICHOLAS P. GODICI

*Attesting Officer*

*Acting Director of the United States Patent and Trademark Office*